US012593880B1

(12) United States Patent
Houston

(10) Patent No.: US 12,593,880 B1
(45) Date of Patent: Apr. 7, 2026

(54) GARMENT FOR HOLDING AN INFANT SKIN-TO-SKIN AND USES THEREOF

(71) Applicant: Sylvia Houston, Loganville, GA (US)

(72) Inventor: Sylvia Houston, Loganville, GA (US)

( * ) Notice: Subject to any disclaimer, the term of this patent is extended or adjusted under 35 U.S.C. 154(b) by 0 days.

(21) Appl. No.: 18/319,449

(22) Filed: May 17, 2023

Related U.S. Application Data

(60) Provisional application No. 63/343,080, filed on May 17, 2022.

(51) Int. Cl.
*A41D 1/00* (2018.01)
*A41D 1/215* (2018.01)

(52) U.S. Cl.
CPC ..... *A41D 1/215* (2018.01); *A41D 2300/32* (2013.01); *A41D 2400/482* (2013.01)

(58) Field of Classification Search
CPC ..... A41D 1/21; A41D 1/22; A41D 1/215
See application file for complete search history.

(56) References Cited

U.S. PATENT DOCUMENTS 2,157,482 A * 5/1939 Crossingham ..... A41B 9/06 2/274
6,854,132 B1 * 2/2005 Polzin ..... A41D 1/215 2/104
10,477,904 B2 * 11/2019 Zodel ..... A41D 1/21
11,564,423 B2 * 1/2023 Korte ..... A41D 1/215
11,819,142 B2 * 11/2023 Crystal ..... A47D 13/02
12,022,891 B2 * 7/2024 Kallile ..... A41C 3/12
12,048,336 B2 * 7/2024 Akerson ..... A41D 1/215
2007/0074330 A1 * 4/2007 Azaronak ..... A41D 1/215 2/104
2007/0271675 A1 * 11/2007 Eraca ..... A41D 1/215 2/104
2009/0265830 A1 * 10/2009 Hendrickson ..... A41D 1/215 2/104
2009/0265831 A1 * 10/2009 Hendrickson ..... A41C 3/08 2/104
2013/0131617 A1 * 5/2013 Kovensky ..... A61F 5/4408 604/327
2013/0200116 A1 * 8/2013 Arvan ..... A47D 13/025 224/158
2013/0291279 A1 * 11/2013 Jensen ..... A41D 1/22 2/69
2014/0197214 A1 * 7/2014 Simmer ..... A41D 1/18 224/160
2015/0089710 A1 * 4/2015 Halverstadt ..... A41D 1/215 2/69
2016/0198865 A1 * 7/2016 Houston ..... A47D 13/025 224/158
2016/0206011 A1 * 7/2016 Houston ..... A61M 1/067
2018/0035725 A1 * 2/2018 Carlton ..... A41C 3/02
2018/0064178 A1 * 3/2018 Akerson ..... A41C 3/02
2018/0064187 A1 * 3/2018 Baker ..... A41D 10/00
2018/0184728 A1 * 7/2018 Brault ..... A41B 9/06
2018/0325281 A1 * 11/2018 Chiesa ..... A45F 3/02
2020/0093198 A1 * 3/2020 Taylor ..... A44B 1/44
2021/0059323 A1 * 3/2021 Taylor ..... A41D 27/20
2021/0145091 A1 * 5/2021 Gambon ..... A41D 13/1254
2021/0274858 A1 * 9/2021 Garramone ..... A41D 1/215
(Continued)

*Primary Examiner* — Richale L Quinn
(74) *Attorney, Agent, or Firm* — Ballard Spahr LLP

(57) ABSTRACT

The present invention relates to a wrap-style shirt that is used to hold newborns and infants skin to skin.

15 Claims, 18 Drawing Sheets

(56) References Cited

U.S. PATENT DOCUMENTS

| | | | | |
|---|---|---|---|---|
| 2022/0132963 | A1* | 5/2022 | Hinde | A41D 1/22<br>2/105 |
| 2022/0192281 | A1* | 6/2022 | Houston | A45F 5/00 |
| 2024/0206644 | A1* | 6/2024 | Kelly | A47D 13/025 |

* cited by examiner

FIG. 2A
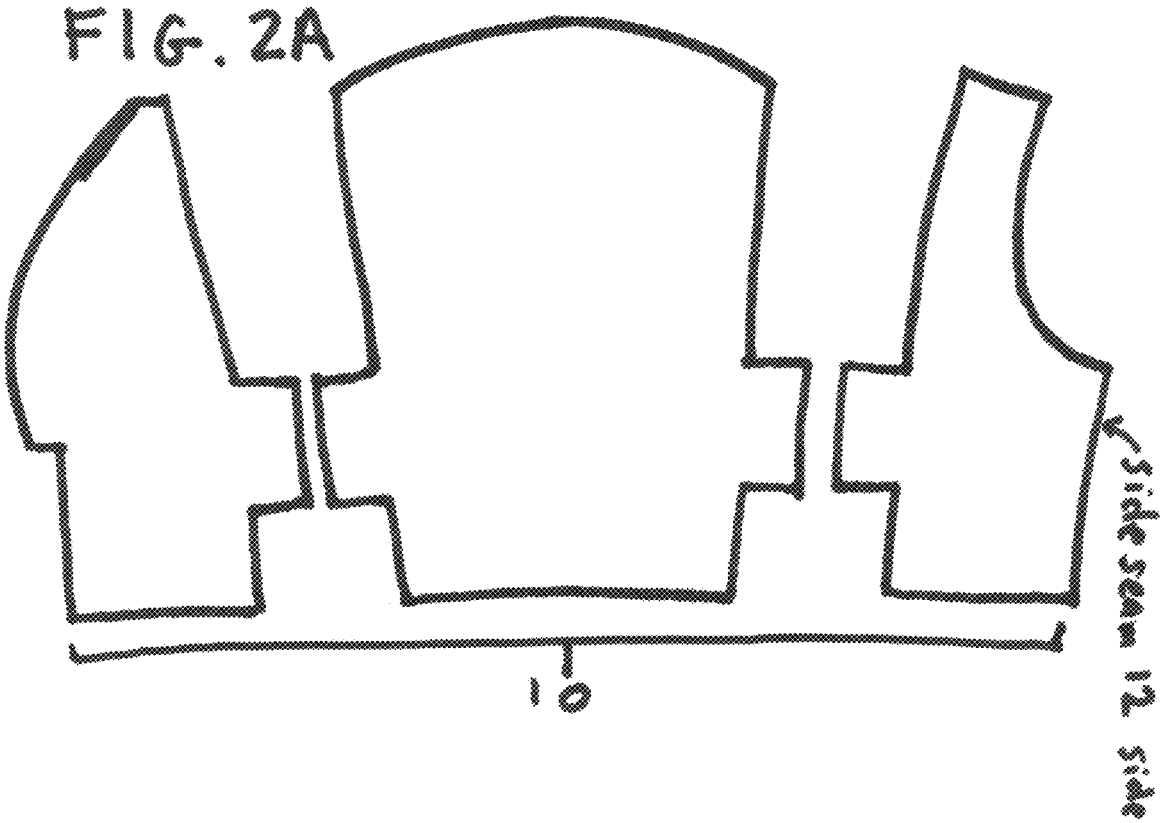
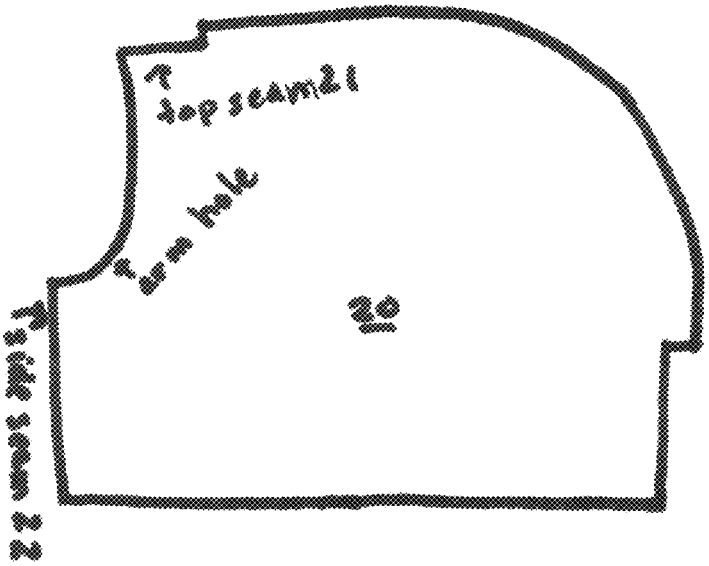
FIG. 2B

GARMENT FOR HOLDING AN INFANT SKIN-TO-SKIN AND USES THEREOF

1. FIELD OF THE INVENTION

The present invention relates to a garment that allows for hands-free holding of an infant. While being held, the infant can nurse from the wearer of the garment, usually the infant's mother. The garment also allows for the infant to be held with skin-to-skin contact between the infant and the wearer of the garment.

2. BACKGROUND

Skin-to-skin contact is the practice where a baby contacts the mother's skin with its bare skin. Ideally, immediately after birth, the newborn can be laid directly on the mother's bare chest, both of them covered in a warm blanket and left for at least an hour or until after the first feed. Skin-to-skin contact can also take place any time a baby needs comforting or calming and can help boost a mother's milk supply. Skin-to-skin contact is vital in neonatal units where it is often referred to as 'kangaroo care'. In neonatal units, it helps parents bond with their baby and supports better physical and developmental outcomes for the baby.

Garments that facilitate skin-to-skin care are needed that can securely and safely hold a newborn, particularly those in neonatal units. Garments that are configured and can be easily adjusted to ensure the airways are not blocked while being held skin-to-skin in the garment; that can securely hold two babies simultaneously; and/or that allow for the mother to simultaneously hold a newborn or infant and pump breastmilk are also needed.

3. SUMMARY OF THE INVENTION

Provided are varous embodiments of a garment that covers the wearer's trunk and that is configured to secure one or two infants between the wearer's chest and the fabric of the garment to provide skin-to-skin contact. The garment also allows for the wearer to pump breast milk without having to remove the garment or displace a section thereof which may otherwise cause exposing the chest area. Methods of using and making the garment are also comtemplated.

An embodiment of the present disclosure is a garment A garment configured to cover a portion of a person's trunk comprising a first front panel; a second front panel; a back panel; a below-breast panel; wherein the first front panel, the second front panel, and the back panel together define the neckline of the garment; wherein the first front panel and the back panel are coupled to each other at a first top seam and a first side seam and together define a first armhole of the garment; wherein the second front panel and the back panel are coupled to each other at a second top seam and a second side seam and together define a second armhole of the garment; and wherein the second front panel is an exterior layer of the garment configured to cover a portion of the first front panel; a first fastener located under the second armhole, wherein the first front panel is configured to releasable couple with the first fastener; a second fastener located under the first armhole, wherein the second front panel is configured to releasably couple with the second fastener, wherein the below breast panel is coupled to another panel of the garment under the second armhole at a first section of the below breast panel and is configured to releasably couple to the second fastener at a second section of the below-breast panel. In a further embodiment, the garment has a line holder affixed near one or both shoulders.

Another embodiment is a method of using the garment while holding a newborn or infant skin to skin and/or pumping breastmilk. The method comprises placing the newborn or infant between the wearer and a first or second panel of the garment and unfolding the neckline-defining edge of a first or second panel and placing the unfolded panel portion around the newborn or infant.

Another embodiment is a method of making the garment with the pattern as depicted in FIGS. 2A to 2G. The method comprises coupling the sides of the panels together at the seams described herein, such as by stitching.

4. BRIEF DESCRIPTION OF THE FIGURES

Figure 1A:
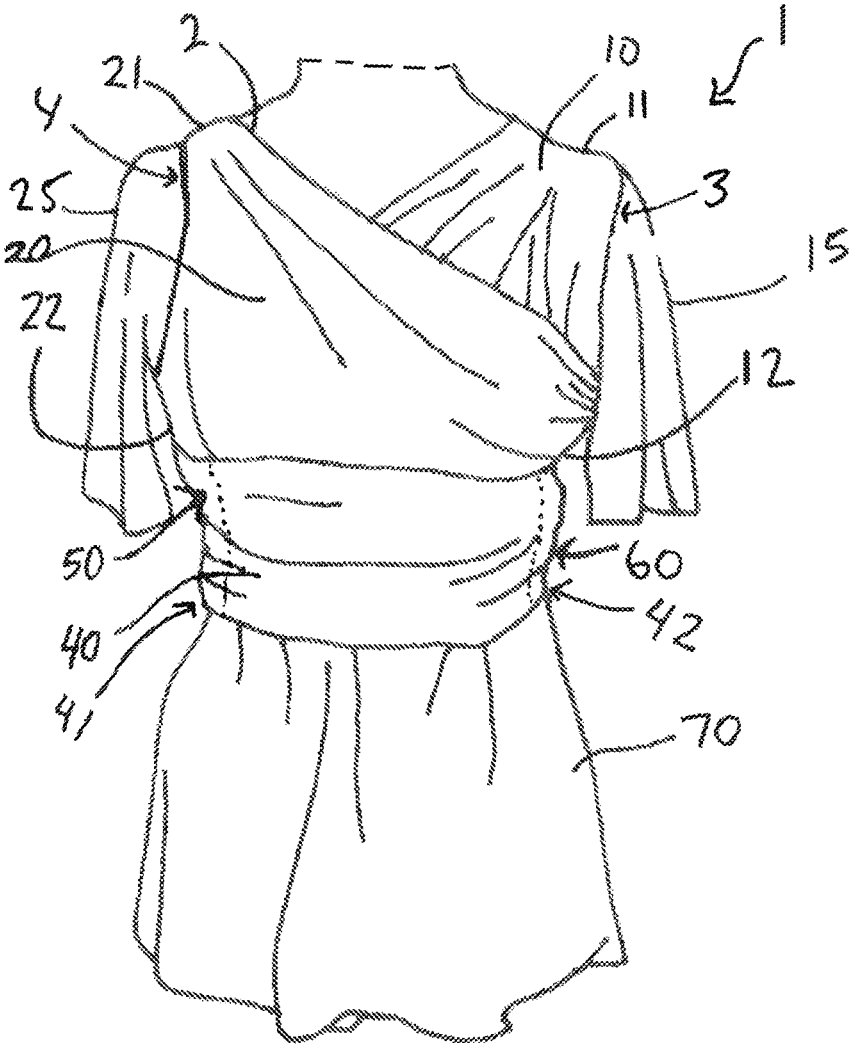
FIG. 1A depicts a front view of an emobidment of the garment 1.
Figure 1B:
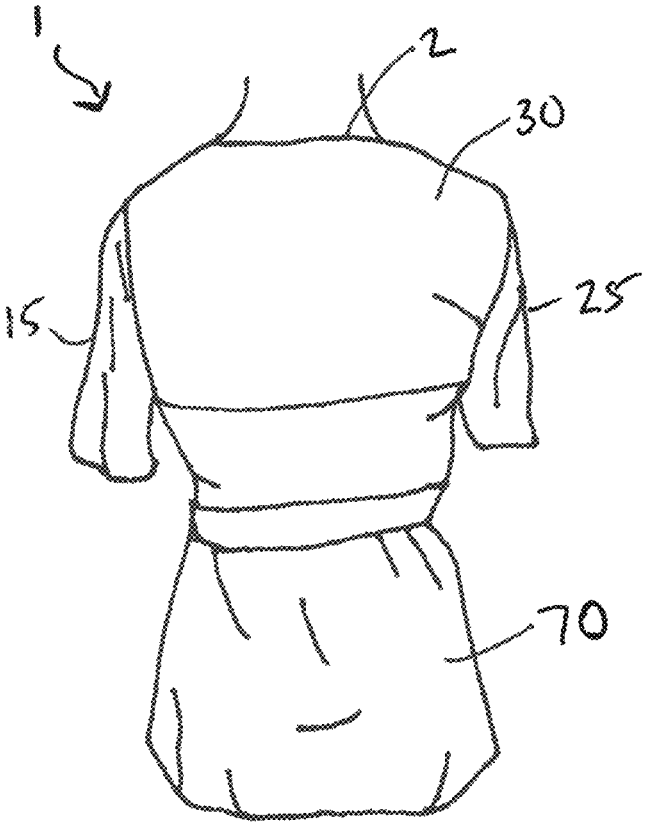
FIG. 1B depicts a back view of the garment depicted in FIG. 1A.
Figure 1C:
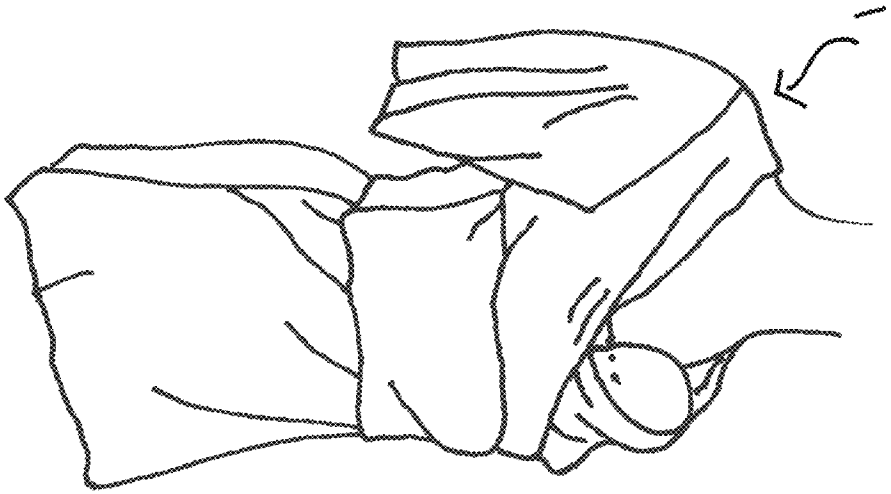
FIG. 1C depicts a front side perspective view of the garment depicted in FIG. 1A with an infant being held skin-to-skin in a slightly horizonatal orientation (or cradle position) the garment 1.
Figure 1D:
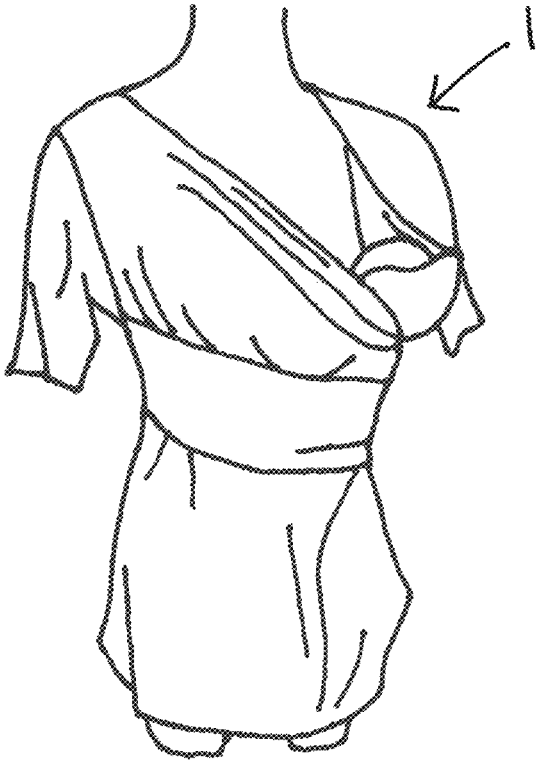
FIG. 1D depicts a front side perspective view of the garment depicted in FIG. 1A with an infant being held skin-to-skin in the cradle position in the garment 1 and nursing from one of the wearer's breast.
Figure 1E:
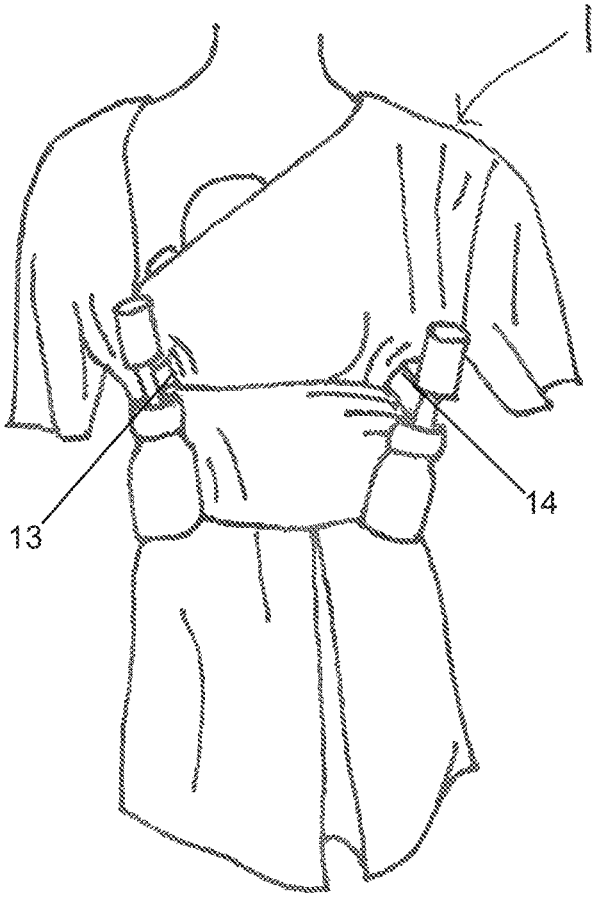
FIG. 1E depicts a front view of the garment depicted in FIG. 1A with an infant being held skin-to-skin in a vertical orientation between the breasts with two breast pump shield componenents being utilized, one for each breast.
Figure 1F:
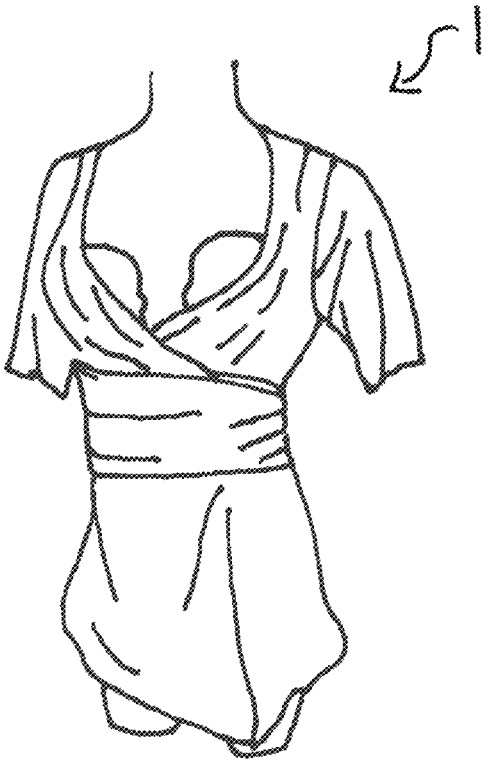
FIG. 1F depicts a front, side view of the garment depicted in FIG. 1A with two infants being held skin-to-skin in a generally vertical orientation. The bodies can be bent or straight.
Figure 1G:
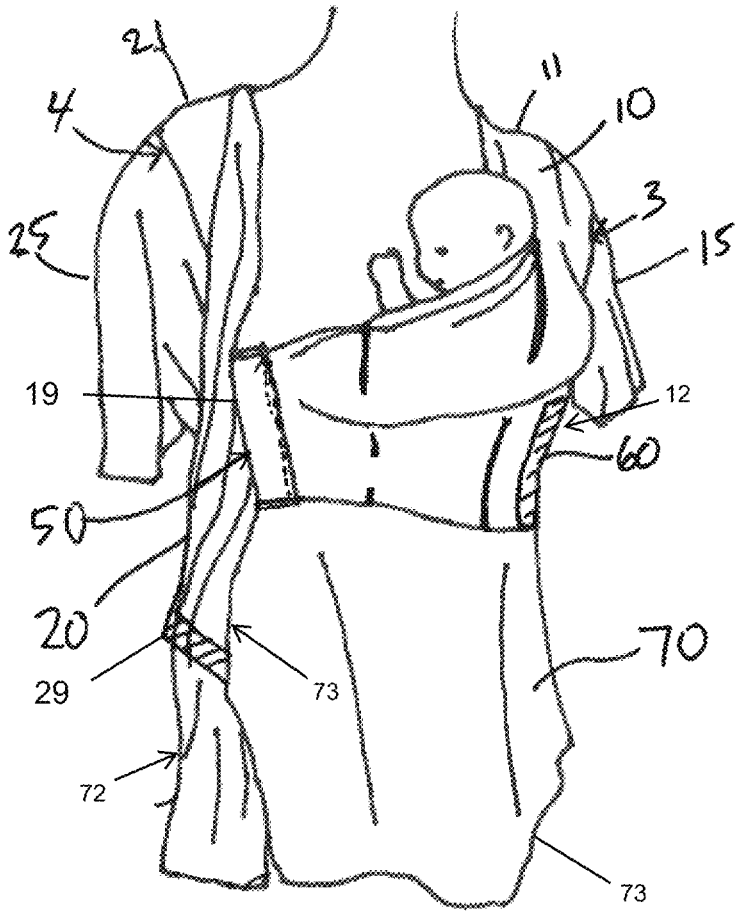

FIG. 1G depicts a front, side view of the garment depicted in FIG. 1A with an infant being held by only the first front panel 10, as the second front panel 20 and sash 40 are shown unfastened and hanging to the side.

Figure 1H:
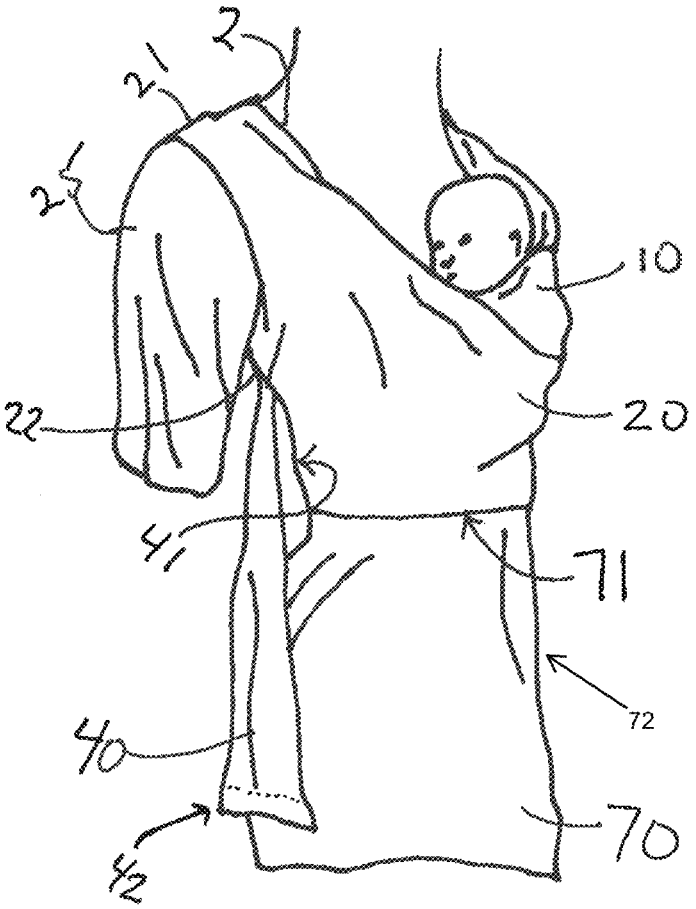

FIG. 1H depicts a front, side view of the garment depicted in FIG. 1A with an infant being held and sash 40 being shown unfastened and hanging to the side.

Figure 1I:
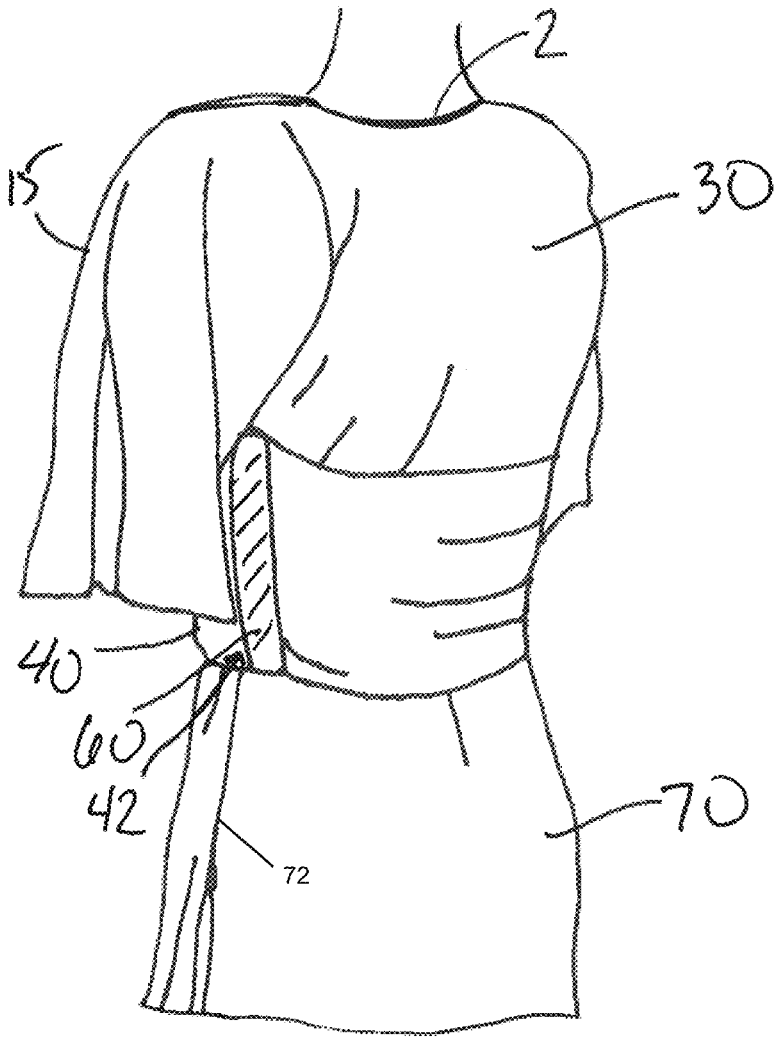

FIG. 1I depicts a back, side persepective view of the garment depicted in FIG. 1A.

Figure 2C:
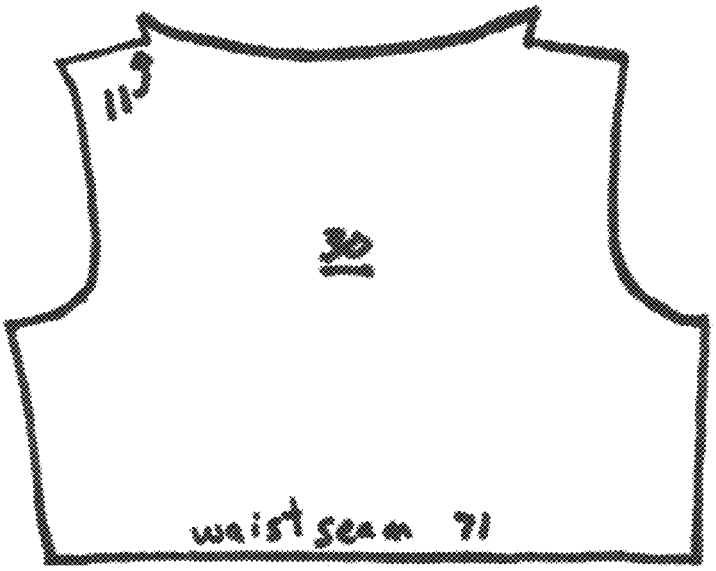
Figure 2D:
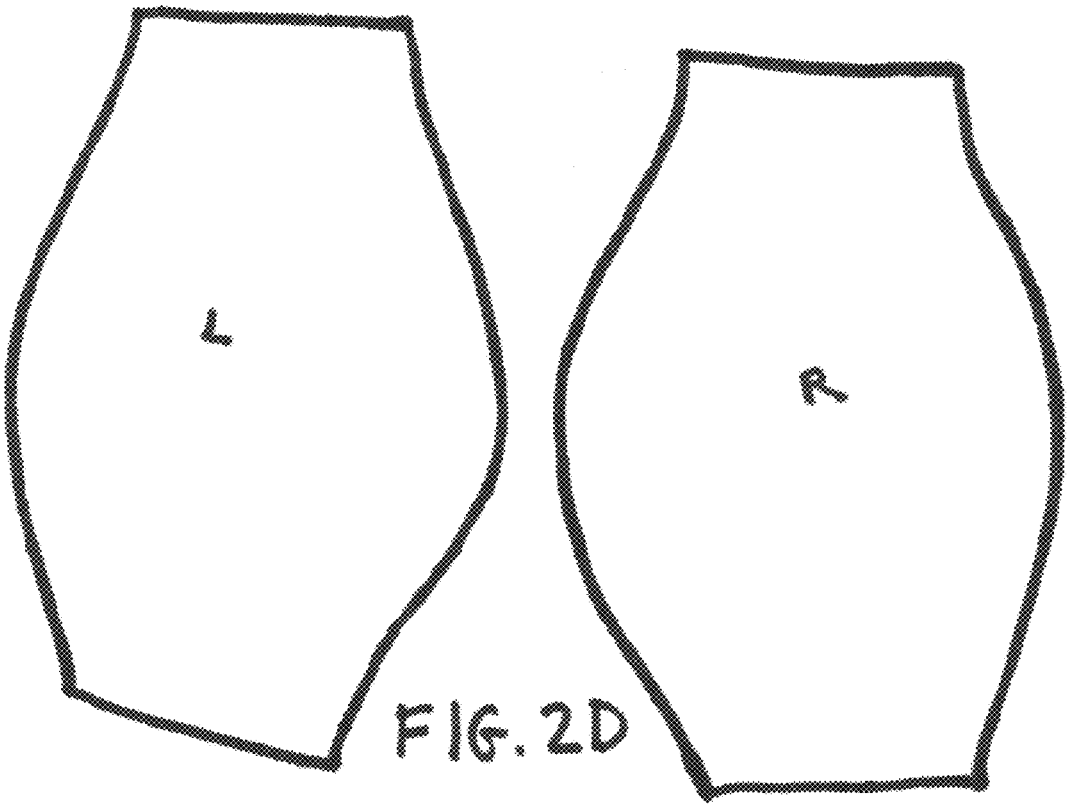
Figure 2E:
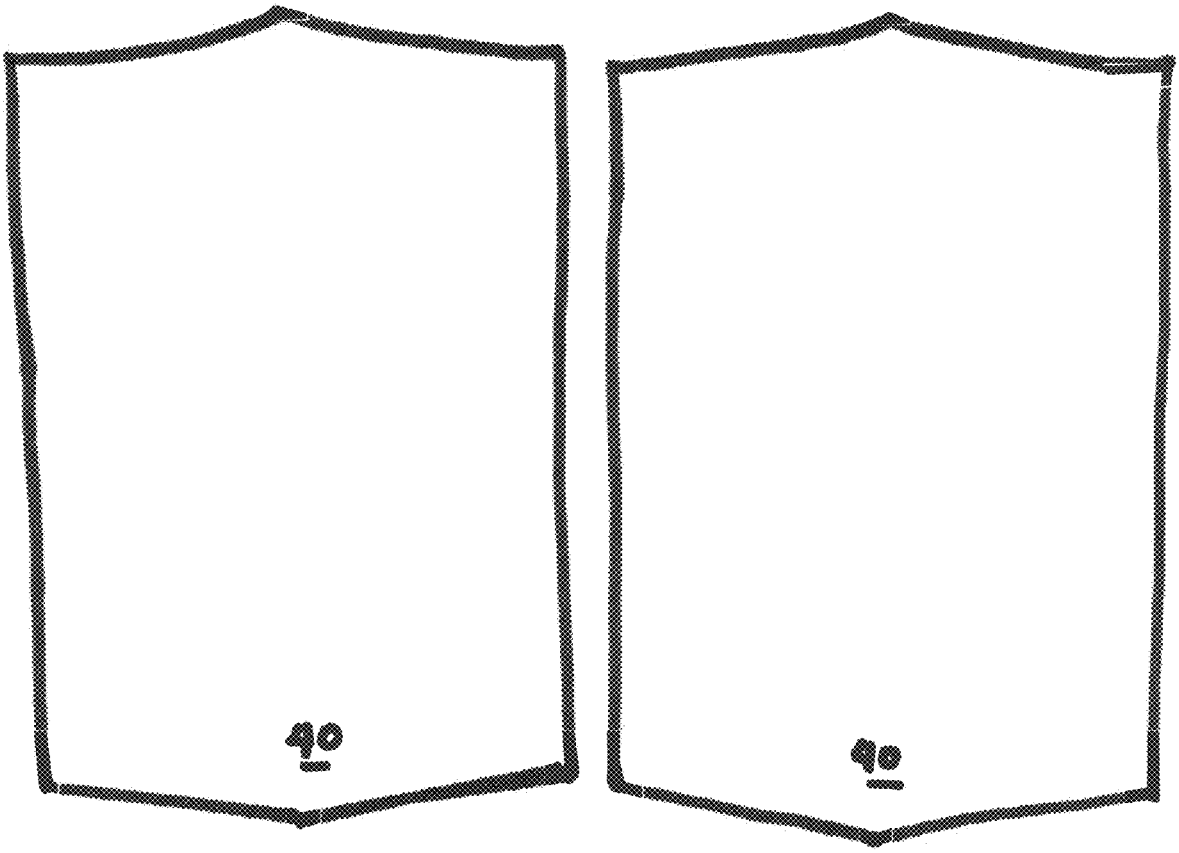
Figure 2F:
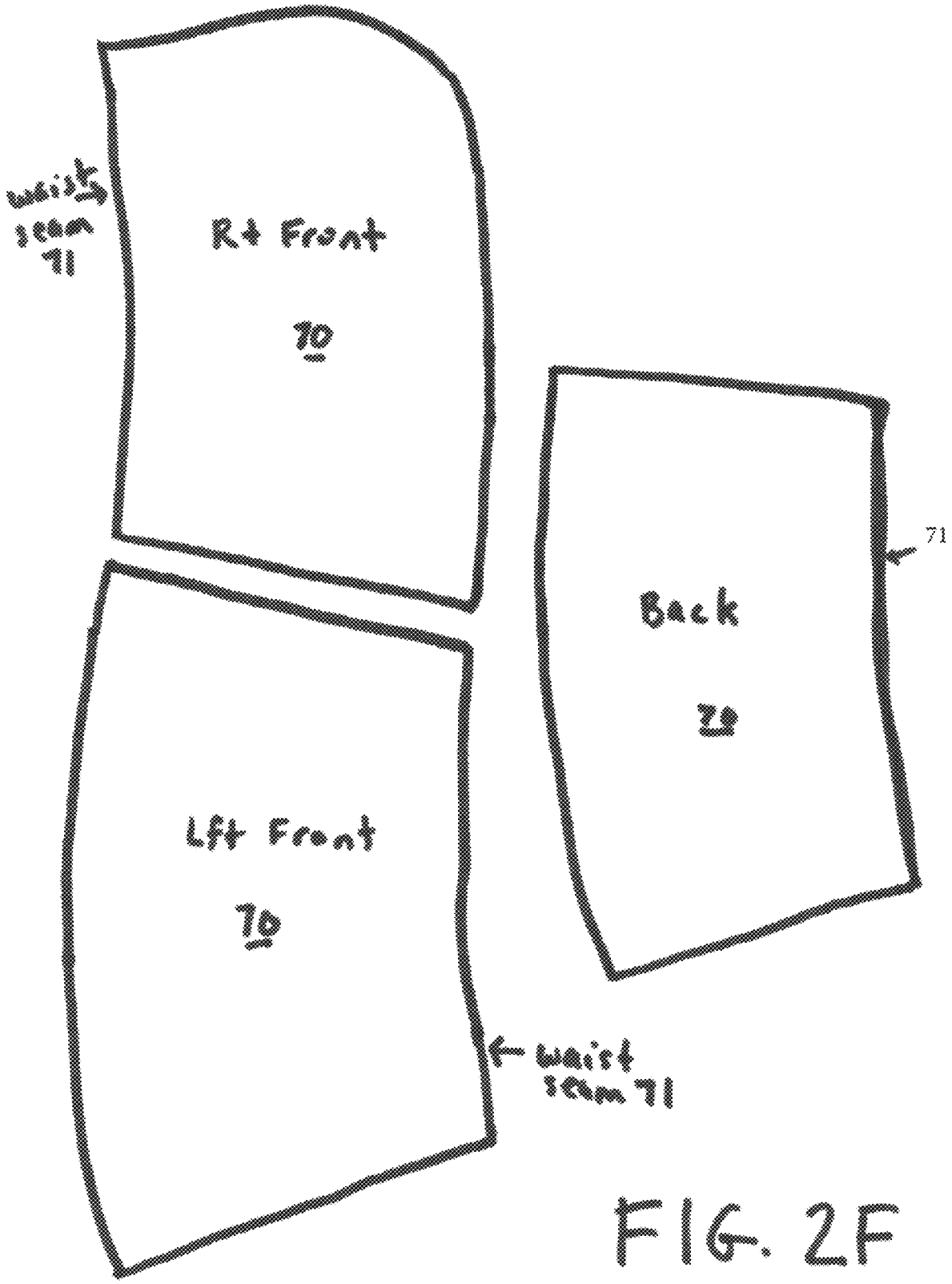
Figure 2G:
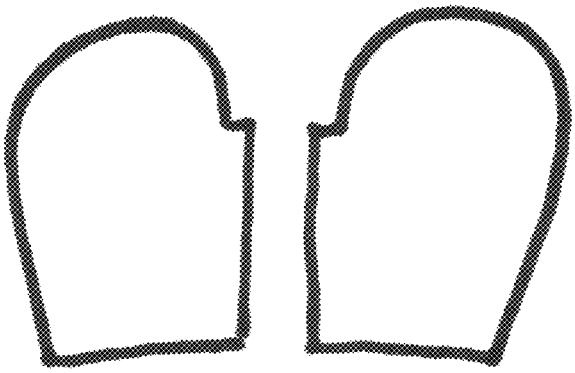
Figure 2H:
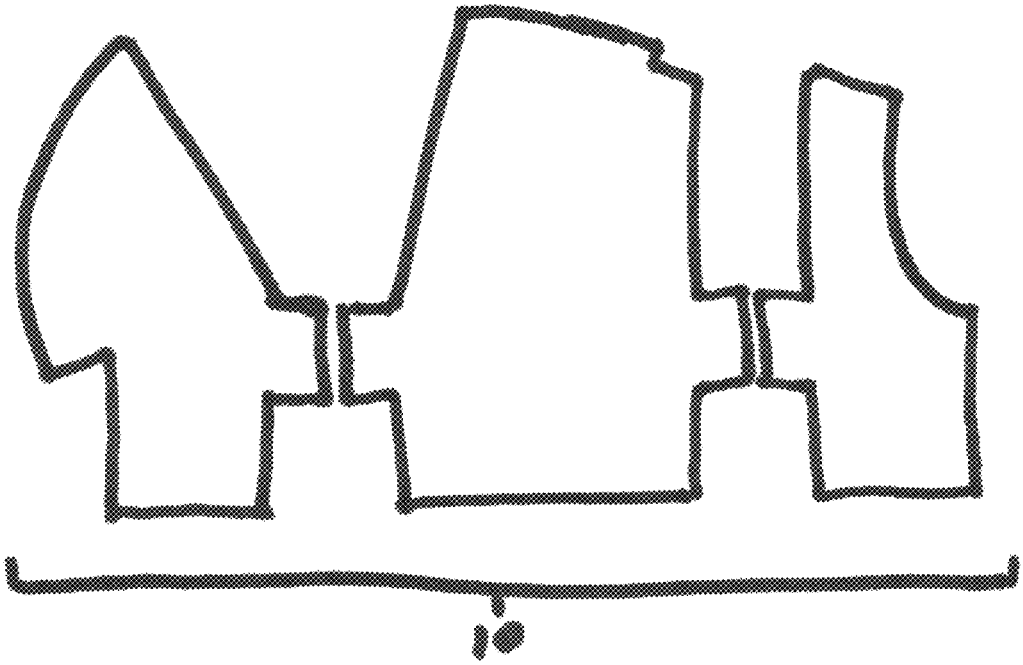

FIG. 2A-2G depicts pattern pieces that can be joined by stitching or otherwise to form the garment depicted in FIGS. 1A to 1I. FIG. 2A depicts an embodiment of first front panel 10. FIG. 2B depicts a second front panel 20. FIG. 2C depicts a back panel 30. FIG. 2D depicts sleeves. FIG. 2E depicts sash 40. FIG. 2F depicts lower trunk panel. FIG. 2G depicts pockets. FIG. 2H depicts another embodiment of first front panel 10, which is more form-fitted at the breast than the embodiment despiced in FIG. 2A.

Figure 3:
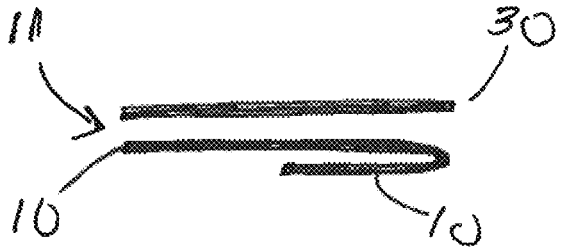

FIG. 3 depicts a cross-sectional view of a top seam.

FIGS. 4A-4E depicts a close-up, top view of a line holder that can be located on a shoulder of the garment depicted in FIGS. 1A to 1I.

In the figures, a lead line with an arrow usually indicates the area in which an element is located and does not necessarily mean the element at which the arrow is pointing is the element. For example, in such circustances, the element may not be visible from the outer surface of the garment or the element is referring to a space, such an armhole.

5. DETAILED DESCRIPTION

The inventor has designed a garment configured to cover a portion of a person's trunk that facilitate one or more of the following tasks: holding an infant without having to use one's arms or hands, pump breast milk without having to remove the garment or expose one's shoulder, have skin to skin contact with the infant when holding, and nursing the infant while holding.

With reference to FIGS. 1A to 1I depicting an embodiment of a garement in accordance with the preset disclosure, the garment 1 is a shirt that comprises a first front panel 10; a second front panel 20; a back panel 30; a below-breast sash 40, a first fastener 50, a second fastener 60, and a lower trunk panel 70. The first front panel 10, the second front panel 20, and the back panel 30 together define the neckline 2 of the garment 1. (The "neckline" as used herein is the top edge of the garment that surrounds the neck.) The first front panel 10 and the back panel 30 are coupled to each other at two seams 11, 12 (referred to as top and side seams respectively), and together define a first armhole 3 of the garment 1. The seams 11, 12 are shown here at the shoulder and along the side of the trunk, under the arm. Similarly, the second front panel 20 and the back panel 30 are coupled to each other at two seams 21, 22 (referred to as top and side seams respectively) and together define a second armhole 4 of the garment 1. The seams 21, 22 are also shown here at the shoulder and along the side of the trunk, under the arm. The first front panel 10; the second front panel 20; and the back panel 30 are coupled to the lower trunk panel 70 at a waist seam 71. (A "panel" can be one unitary piece of fabric (i.e., panel without seams) or multiple pieces of fabric joined together such as to form one or more seams by stitching or otherwise within the panel.) In the embodiment shown, sleeves 15, 25 are present but are optional. FIG. 2D depicts the pattern of an embodiment of right and left short sleeves.

Garment 1 has a wrap type style. As such, the second front panel 20 is an exterior layer of the garment 1 configured to cover a portion of the first front panel 10. The first front panel 10 is sized and shaped to cover the area of the front upper trunk between one shoulder and the waist. The first front panel 10 can be configured such that it covers only one breast on the same side as the one shoulder or covers both breasts. Similarly, the second front panel 20 can be the approximate mirror image of the first front panel 10, sized and shaped to cover the area of the front upper trunk between the opposite shoulder and the waist. An example of the pattern for the two panels 10 and 20 is shown in FIGS. 2A and 2B, respectively. (It can be appreciated from FIG. 2A that panel 10 is formed from three pieces of fabric in the embodiment shown. Three fabric pieces are used to incorporate into the embodiment openings 13, 14 for breast pump shield as discussed below. However, it is understood that panel 10 could be a unitary piece of fabric that is an approximate mirror image of panel 10 for an embodiment without openings 13/14.)

To maintain the wrap-style shirt in a closed, as-worn configuration, two fasterners 50 and 60 are used. FIG. 1G depicts garment 1 with the second front panel 20 unfastened and hanging to the side (as is sash 40 discussed below) to facilitate understanding of how two fasteners 50, 60 are used in the shirt. The first fastener 50 is located under the second armhole 4 on a an interior face of the garment 1, and the first front panel 10 has a free side 19 (which is the side of the panel that is opposite to the side that is joined to the back panel at side seam 12) that is configured to releasably couple to the first fastener 50. Similarly, a second fastener 60 is located under the first armhole 3 on an exterior facing face of the garment, wherein the second front panel 20 has a free side 29 (which is the side of the panel that is opposite to the side that is joined to the back panel at side seam 22) that is configured to releasably couple to the second fastener 60. To remove the garment with ease, these fasterners 50, 60 must be released. The lower trunk panel 70 is sized to cover the lower portion of the trunk and can be configured to permit the garment 1 to be partially or completely open on the front side if the the two fastener 50, and 60 are unfastened. The embodiment shown allows for the garment to be completely open and thus lower trunk panel 70 is coupled to the garmet at the waist seam and has three free ends, 72, 73, and 74. To be a wrap style that only partially open, a portion of free ends 72 and 73 can be coupled to eachother at a seam.

Either one or both of fasteners 50 and 60 can be configured to allow for adjustability to tighten or loosen the degree of wrapping, in other words, to adjust the degree of tightness of the wrap-style shirt around the trunk.

To further secure the wrap-style shirt in a closed, as-worn configuration, the shirt can further comprise a below-breast sash 40, which can be a below-breast half sash. (Half-sash means a sash that extends across the front but does not encircle the wearer like a full sash.) FIG. 1A depicts a sash 40 fastened. FIG. 1H depicts the garment 1 with the sash 40 unfastened and hanging to the side. As can be appreciated from FIG. 1H, the sash 40 is fixed to the garment on one side and is a half sash. The below-breast sash 40 has a form that is somewhat like a cumberbund, but sits a little higher than where a cumberbund would sit on a male wearing a traditional tuxedo. The sash 40 when fastened is located in the area from the waist and to the bottom-most edge of the breasts. The sash 40, as an additional means of securement, provides additional fastening strength and support underneath the infant to maintain the wrap position of the shirt 1. Such strength can be useful given that the shirt 1 is intended to hold an infant. In the embodiment shown, the sash 40 is a half-sash coupled to the garment 1 at one of its ends 41 (or sections) under the second armhole 4 and is configured to releasable couple to the second fastener 60 under the first armhole 3 at its other end 42 (or at another intermediate section of the below-breast sash 40). Alternatively, the sash 40 could be coupled anywhere at or between side seams 12 and 22 on the back panel 30 and/or the lower trunk panel 70. The second fastener 60 is also configured to allow for adjustability to tighten or loosen the degree to which the sash 40 is wrapped around the trunk. In other words, the fastener is configured to allow for adjustability to shorten or lengthen the sash at the point of the sash's attachment to fastener 60. A pattern for an embodiment of a sash 40 that is somewhat like a cumberbund is shown in FIG. 2E. For the embodiment shown in FIG. 2E, one piece is used to be located on the part of the garment and is secured to the garment at or near each side seam. The other is the half sash that is secured to the garment at one end.

In addition to the above-mentioned functions, the sash 40 can also be used to support an infant that is being held between the garment 1 and the wearer's skin. If desired, a portion of the sash can 40 overlay a portion of the infant for additional support.

The sash 40 can have a length that permits the sash to fit somewhere between half way around the wearer's trunk in the area of the trunk under the breasts and at or above the naval, once around the wearer's trunk in this same area or more. The sash 40 can have a width that is 3 inches to 7 inches (or about 7 to about 18 cm). (The width is the shorter dimenstion that is generally perpendicular to the waist seam when the sash is in its closed position, fastened.) In an embodiment, the width is 5 to 6 inches (or about 12 or 13 cm to 15 or 16 cm).

The sash 40 is composed of a knitted or otherwise stretchable fabric. The sash 40 can comprise one, two, or three layers of the fabric. In an embodiment, the sash is two layers. A sash 40 of multiple layers can increase the amount of tension required to elongate the sash as compared to a sash 40 of less layers of the same fabric, making it more supportive.

To facilitate supporting the infant, portions of the first front panel 10 and the second front panel 20 can be sized and shaped such that the section of the fabric forming the neckline is a folded portion of the panel that can be unfolded to enlarge the area of the fabric for covering and supporting the infant. As such, the folded edge of each panel 10, 20 defines a respective portion of the neckline.

The panels 10 and 20 can be folded and fixed at the respectived top seam 11/21 in order to bias the panel to a folded conformation along the neckline. Alternatively or additionally, the panels 10 and 20 can be folded and fixed near the free sides 19 and 29 of the panels 10 and 20 in order to bias the panel to a folded conformation along the neckline. In other words, at the top seam 11 and/or 21 and/or near the free sides 19/29 of the first front panel 10 and/or the second front panel 20, the panel is folded and the fold is fixed by stitching the fold into the seams 11 or 21 and/or tacked down at or near the free sides 19/29. FIG. 3 shows a deconstructed, exploded cross-sectional schematic view of the top seam 11 illustrating the layers of fabric that are stitched at the seam. As shown, there are two layers of the first front panel 10 within the top seam 10. Near the free side 19/29, the fold is fixed such as by stitching. The fixing of the fold at the ends of a fold allow for increased tension on the fabric than would otherwise be if not fixed when an infant is being held, particularly when the panel is unfolded to cover the infant.

In some embodiments wherein the panel 10 or 20 is folded at both the top seam and the free side 19/29, the depth of the fold at the free side 19/29 is about twice as that on the top seam 11/21 allowing for a larger section of fabric to cover the infant nearer the free side than near the top seam 11/21. This can aid in keeping the infant's face uncovered while being held by the garment 1.

To provide adequate or additional support and/or coverage to the infant and the wearer, one or both of the two front panels 10 and 20 can have a convex edge which is the section that is folded under to form the neckline. In some embodiment, the convex edge is asymmetrical, such that the apex of the curve is closer to the waist seam 71 than the top seam 11/21. This can also aide in keeping the infant's face uncovered while being held by the garment 1.

The second front panel 20 can be layered at the top seam 21 and the waist seam 71 in the same manner and with the asymmetrical convex curve as described above.

The amount of fabric that is folded under (i.e., the depth of the fold) can be as much as 8 in. (20 cm) from the folded edge (which forms the neckline) to the edge or as little as 2 inches. In an embodiment where the edge of the panel is curved or asymmetrical, the maximum depth of the fold can be 5 to 8 in., such as 6 to 7 in., and the shallowest depth can be at the top seam 11 or 21, at 0.5 to 2 in. (1-5 cm), such as 0.8 to 1.5 in. At the waist seam 71, for an embodiment where the edge is curved, the depth of the fold can be 1 to 3 in. (2 to 8 cm).

In an embodiment, the garment 1 can be configured to facilitate breast pumping by having a small slit (or opening) configured to allow a breast shield component of a breast pump to fit through garment 1 to contact the breasts. As can be appreciated from the embodiment shown in FIG. 1E, a first front panel 10 can define two openings 13, 14, each sized and shaped to receive a breast shield component of a breast pump. In an embodiment, the first front panel 10 can comprise at least three pieces of fabric that are joined together by at least two seams 15, 16 wherein each opening is formed by a discontinuous section (e.g., 1-2.5 inch in length)) within the seams 15, 16 joining two of the three pieces of fabric. When the garment 1 is worn and the first front panel 10 is fastened, opening 13 would be near or at least allow for access to the areola of one breast and opening 14 would be near or at least permit access to the areola of the other breast.

A pattern of the three pieces of fabric forming the first front panel 10 with two openings are shown in FIG. 2A. The openings 13, 14 are configured to prevent a portion of the breast to be exposed through the opening. At each end of the opening 13, 14, the two raw edges of excess fabric are fixed (by way of stitching or otherwise) to one side of the seam, e.g., seam 15. This allows for the opening 13, 14 to be like a shallow pocket that is not sealed at its base. In addition the excess fabric forming the opening is deeper than the excess fabric at the seam in order to form a sufficiently deep pocket-type opening. The excess fabric forming the pocket-like opening is shown at elements 17 and 18 in the pattern panels of FIG. 2A. This configuration forms a fabric curtain at the opening to prevent accidental exposure of the breast through the opening.

When the wearer is holding an infant in the garment 1, some tension may be placed on the neckline. In some embodiments, to minimize the degree of elongation of the portion of the neckline formed by the back panel 30 can be reinforced with a strip of material located at and optionally inside the hem at back panel neckline 31. The strip of material is not visible in FIG. 1B as it is located within the hem but dashed lines 32 show its location within the garment 1. The strip of material can be held in position with the same stitching that is forming the hem. With the strip of material 32 in the hem, the back panel neckline 31 can be at least 1.5 or 2 times less elastic than the hem of the neckline would otherwise be without the strip of material. In some embodiments, the strip of material is braided or knitted elastic.

As mentioned above, one or both fasteners 50, 60 can be configured to adjust the tightness of the wrap. For example, the first fastener 50 can be configured such that the first front panel 10 can couple to the first fastener 50 at different locations on the first fastener 10 or different locations on the first front panel thereby changing the transverse perimeter of garment 1 below the breast. Similarly, the second fastener 60 can be configured such that the second front panel 20 can couple to the second fastener 60 at different locations on the second fastener 60 or different locations on the second front panel 20 thereby changing the perimeter of garment below the breast. In some embodiments, the different locations on the first front panel 10 can be spaced apart at least 2 inches. Similarly, in some embodiments, the different locations on the second panel can be spaced apart at least 2 inches. To facilitate ease of opening, closing, and adjusting the wrap style garment 1, the first and second fasteners 50, 60 can comprise a component of a hook-and-loop (aka, hook-and-pile) fastener, and the other component of the hook-and-loop fastener can be coupled to the free sides 19/29 or the first front panel 10 and the second front panel 20, respectively.

In some embodiments, the first fastener 50 is a panel of either the hook or loop component of a hook and loop fastener coupled to the back panel and/or the second front panel. The panel forming the first fastener 50 can be 2 to 6 in. wide and 3 to 8 in. in height, such a 3-5×5-7 in. panel 51.

Similarly, the second fastener 60 can also be a panel of either the hook or loop component of a hook-and-loop fastener coupled to the back panel 30 and/or the first front panel 10. The panel of the second fastener 60 can have similar dimensions as the panel of the first fastener 50. Adjusting the fastening location along the width of first fastener panel and/or the second fastener panel affects the tightness of the wrap. In an embodiment, the first fastener panel and the second fastener panel are each about 4 in. wide centered on side seam 12/22 with about 2 in. towards front and 2 in. towards back with a height of 6 in.

The free side 19 of the first front panel 10 can have coupled thereto the corresponding component of the hook-and-loop fastener. The hook-and-loop fastener can be coupled to an exterior face of the first front panel to affix to the first fastener panel 51 which is coupled to an interior face of garment 1. Similralry, the free side 29 of the second front panel 20 can have coupled thereto the corresponding component of the hook-and-loop fastener. The hook-and-loop fastener can be coupled to an interior face of the second front panel 20 to affix to the second fastener panel 61 which is coupled to an exterior face of garment 1. The corresponding hook-and-loop fastener component that couples to each of the fasterner panels 51/61 can have a height that is the approximately the same as the first and second fastener panels 51/61 and a width that is 0.5 to 3 inches wide, such as 1 in. wide.

In some embodiments, the height of panel 51 can be approximately the same as the width of the sash 40. In the embodiment shown, the sash 40 can also comprise a corresponding component of a hook-and-loop fastener to couple to the hook-and-loop panel 51.

In some embodiments, the garment 1 has at least one pocket that is coupled to the lower trunk panel 70. It can be a side pocket that is accessible at a side seam or on the outer face of the panel. The pocket is sized to hold a handheld device, such as a smart phone. A pattern for a side pocket embodiment is shown in FIG. 2G.

To facilitate secure and comfortable holding of the infant, the first front panel and the second front panel are of a stretchable fabric, such as knitted fabric. The types of knit that can be used include a jersey knit, purl knit, rib stitch knit, Milano rib kit, interlock stitch knit, double knit, warp knit, tricot knit, raschel knit, cable knit, brid's eye knit, pointelle knit, intarsia knit, or jacquard knit.

In some embodiments, the garment is used in a clinical setting, such as in a maternity ward or NICU of the hospital. In such settings, it can be useful for the garment to be white or pastel to allow for a quicker visual inspection of the wearer or the infant. However, different colors or decorative textures or patterns are envisioned.

Figure 4A:
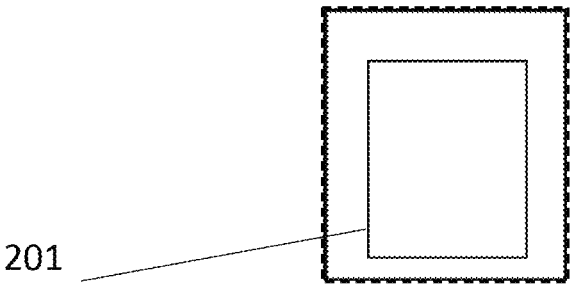
Figure 4B:
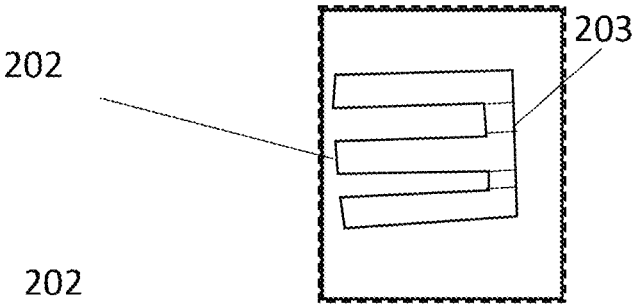
Figure 4C:
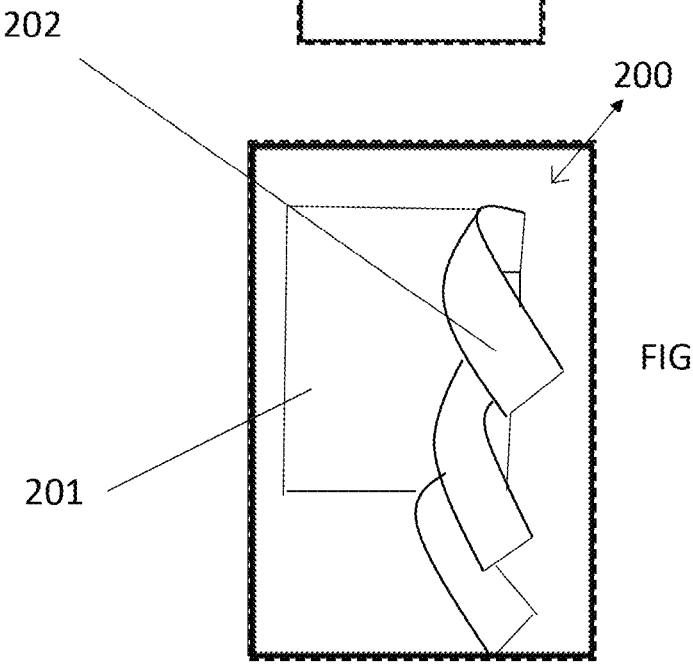
Figure 4D:
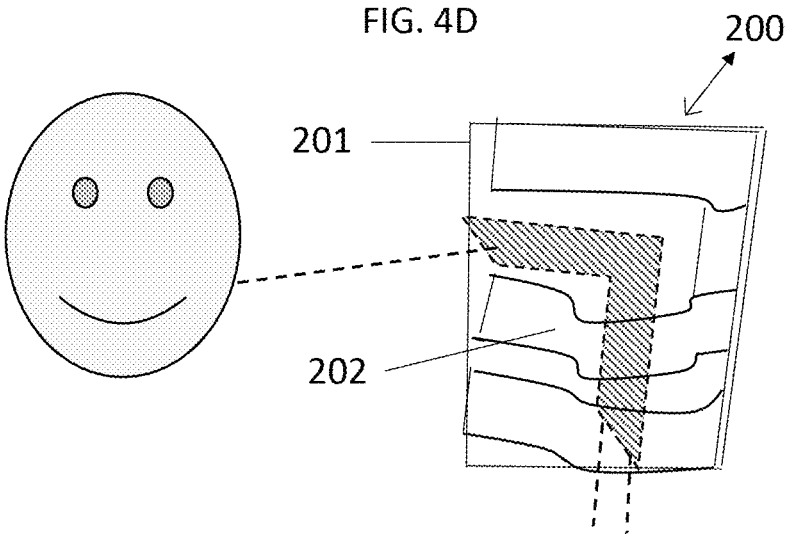
Figure 4E:
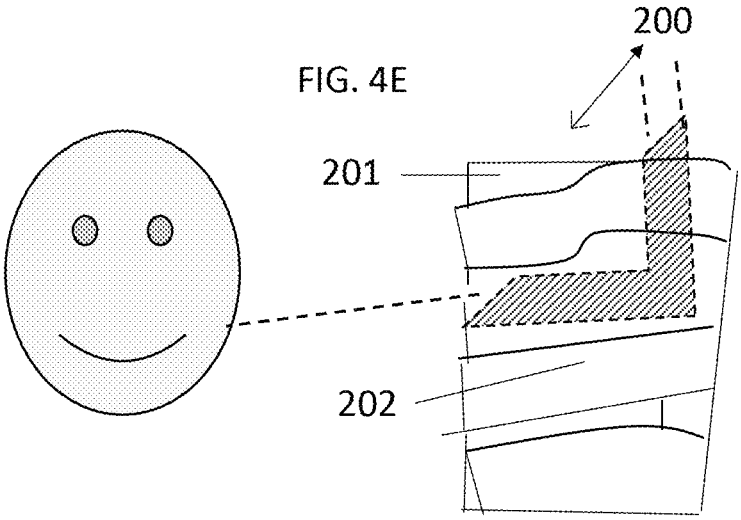

With reference to FIGS. 4A to 4D, in some embodiment, garment 1 further comprises one or two line holders 200 located near the left and/or right of the shoulders of garment 1. A line that may be secured by the line holder 200 is a tube that delivers a fluid, which can be an oxygen line and a feeding tube for the infant. The line holder 200 can comprise a panel 201 that is coupled, relesably or fixedly, to 1, 2, 3, 4, 5, or more straps 202. The embodiment depicted as 3 straps. At least one end section of each strap 202 is configured to releasably fasten to the panel 201 or the garment 1. FIG. 4C depicts the straps only attaced at one end and the other end dangling free. In addition, the strap 202 can releasably couple to the panel 201 at different points along the length of the strip 202. In an embodiment, the line holder can comprise a panel 201 of either the hood or loop component of a hook-and-loop fastener (preferably the softer, loop component of the fastener) coupled to the first front panel 10 and/or the second front panel 20 and located adjacent the first armhole 3 and/or the second armhole 4. The panel 201 can be 2 to 4 in. wide and 2 to 6 in. height. In an embodiment, panel 201 can be about 3.5 in. wide and about 4 in. in height. The line holder 200 further comprises 1, 2, 3, 4, or 5 bendable straps 202 of the corresponding component of the hook-and-loop fastener, each bendable strap 202 is configured to couple to one side of the panel and have a length that is longer than the width panel so that the strap 202 extends past the opposite side of the line holder panel 201. These straps can securely pin a medial tube, such as a vent tube or a feeding tube into place on garment 1. In an embodiment, as illustrated, a plurality of straps 202 are fixedly coupled to the non-fastening side of a strip 203 of the corresponding component of the hook-and-loop fastener (preferably the hook component) that will fasten to the panel on one side so that the plurality of straps 202 can be removed from garment 1 altogether when not in use.

As can be appreciated from FIG. 1C, 1D, and IF, a method of using the garment 1 can comprise placing the garment 1 on a person and placing a newborn or an infant in between the skin of the person and the first front panel 10 and/or the second front panel 20, thereby allowing the baby to be held by the garment and be skin-to-sking with the wearer. As shown, no hands or arms are needed to support the newborn or infant. As shown in FIG. 1F, the method can further comprises palcing a second infant in between the skin of the person and the first front panel 10 and/or the second front panel 20, thereby allowing both infants to be simultaneously held skin-to-skin.

As can be appreciated from FIG. 1E, a method of using the garment 1 can comprises placing a breast shield component in an opening13 or14 and pumping breast milk and optionally placing a second breast shield component in the other opening 13 or 14 to pump from both breasts. The wearer of the garment 1 is not exposed through the opening when not pumping because of the pocket type opening discussed above. The method can further comprise holding an infant between the wearer's skin and the first front panel 10 while pumping.

Although the invention is described in detail with reference to a specific embodiment thereof, it will be understood that variations which are functionally equivalent are within the scope of this invention. Indeed, various modifications of the invention in addition to those shown and described herein will become apparent to those skilled in the art from the foregoing description and accompanying drawings. Such modifications are intended to fall within the scope of the appended claims. Those skilled in the art will recognize, or be able to ascertain using no more than routine experimentation, many equivalents to the specific embodiments of the invention described herein. Such equivalents are intended to be encompassed by the following claims.

I claim:

1. A garment configured to cover a portion of a person's trunk comprising a first front panel;

a second front panel;

a back panel;

a below-breast panel;

wherein the first front panel, the second panel, and the back panel together define the neckline of the garment;

wherein the first front panel and the back panel are coupled to each other at a first top seam and a first side seam and together define a first armhole of the garment;

wherein the second front panel and the back panel are coupled to each other at a second top seam and a second side seam and together define a second armhole of the garment; and wherein the second front panel is an exterior layer of the garment configured to cover a portion of the first front panel;

a first fastener located under the second armhole, wherein the first front panel is configured to releasable couple with the first fastener;

a second fastener located under the first armhole, wherein the second front panel is configured to releasable couple with the second fastener, wherein the below breast panel is coupled to the garment under the second armhole at a first section of the below breast panel and is configured to releasable couple to the second fastener at a second section of the below-breast panel, and wherein the first front panel and the second front panel each have a portion that is folded under, whereby each fold forms a respective portion of the neckline and the first front panel and the second front panel are configured such that each portion folder under has a depth of at least 5 cm from fold to edge in at least a section of the folded portion and such that the section with at least 5 cm depth can be unfolded.

2. The garment of claim 1, wherein the edge of the first front panel and the edge of the second front panel that are folded under each define a convex curve.

3. The garment of claim 1, wherein a depth from fold to edge of each folded portion of the first front panel and the second front panel is greater nearer the first or second side seam than the first or second top seam, respectively.

4. The garment of claim 1, wherein the first front panel defines first and second openings, each opening configured to receive a breast shield component of a breast pump, wherein the first opening is located on the first front panel for placement of the breast shield component on a first breast and the second opening is located on the first front panel for placement of the breast shield component on a second breast.

5. The garment of claim 4, wherein the first front panel comprises at least three pieces of fabric that are joined together by at least two seams, wherein each of the two openings is located at a juncture between two pieces of fabric and the two openings are located at junctures between a different two pieces of fabric.

6. The garment of claim 1, wherein the portion of the neckline defined by the back panel is reinforced with a strip of material in order to be at least 2 times less elastic than the portion of neckline would otherwise be without the strip of material.

7. The garment of claim 1, wherein the first fastener is configured such that the first panel can couple to the first fastener at different locations on the first fastener, the first panel, or both thereby changing the perimeter of garment below the breast and/or wherein the second fastener is configured such that the second panel can couple to the second fastener at different locations on the second fastener, the second panel, or both thereby changing the perimeter of garment below the breast.

8. The garment of claim 7, wherein the first and second fastener are a component of a hook and loop fastener and the other component of the hook and loop fastener is coupled to the first front panel and the second front panel, respectively.

9. The garment of claim 8, wherein the first fastener is a panel of one component of a hook and loop fastener coupled to the back panel and optionally, further the second front panel.

10. The garment of claim 8, wherein the second fastener is a panel of one component of a hook and loop fastener coupled to the back panel and optionally, further the first front panel.

11. The garment of claim 1, wherein the first front panel and the second front panel are a knitted fabric.

12. The garment of claim 1, further comprising a panel of one component of a hook and loop fastener coupled to the first front panel and/or the second front panel and located adjacent the first armhole and/or the second armhole and being at least 2 inches wide and 2 inches in height; and at least two bendable straps of the other component of the hook and loop fastener, each bendable strap coupled to one side of the panel and having a length that is longer than the width panel so that the strap extends past the opposite side of the panel, and optionally wherein the bendable straps are coupled to a strip of the other component of the hook-and-loop fastener so that the bendable straps are able to be separated from the garment.

13. The garment of claim 1, wherein the below breast panel has a height of at least 4 inches.

14. The garment of claim 1, further comprising a second back panel having the same height as the below breast panel that is extending across the back panel and coupled to the second fastener under the first armhole and the second front panel under the second armhole.

15. A garment configured to cover a portion of a person's trunk comprising a first front panel;

a second front panel;

a back panel;

a below-breast panel;

wherein the first front panel, the second panel, and the back panel together define the neckline of the garment;

wherein the first front panel and the back panel are coupled to each other at a first top seam and a first side seam and together define a first armhole of the garment;

wherein the second front panel and the back panel are coupled to each other at a second top seam and a second side seam and together define a second armhole of the garment; and wherein the second front panel is an exterior layer of the garment configured to cover a portion of the first front panel;

a first fastener located under the second armhole, wherein the first front panel is configured to releasable couple with the first fastener;

a second fastener located under the first armhole, wherein the second front panel is configured to releasable couple with the second fastener, wherein the below breast panel is coupled to the garment under the second armhole at a first section of the below breast panel and is configured to releasable couple to the second fastener at a second section of the below-breast panel, and wherein the first front panel and the second front panel each have a portion that is folded under, whereby each fold forms a respective portion of the neckline and wherein the edge of the first front panel and the edge of the second front panel that are folded under each define a convex curve.

* * * * *